United States Patent [19]

Horodysky

[11] Patent Number: 4,541,942

[45] Date of Patent: Sep. 17, 1985

[54] BORATED EPOXYHYDROCARBON-PHENOL SULFIDE PRODUCT AND LUBRICANT AND FUEL COMPOSITIONS CONTAINING SAME

[75] Inventor: Andrew G. Horodysky, Cherry Hill, N.J.

[73] Assignee: Mobil Oil Corporation, New York, N.Y.

[21] Appl. No.: 616,753

[22] Filed: Jun. 4, 1984

[51] Int. Cl.[4] ..... C10M 1/54

[52] U.S. Cl. ..... 252/49.6; 252/46.3; 260/462 R

[58] Field of Search ..... 252/46.3, 49.6; 260/462 R

[56] References Cited

U.S. PATENT DOCUMENTS

| | | | |
|---|---|---|---|
| 4,305,832 | 12/1981 | Braid | 252/48.2 |
| 4,382,006 | 5/1983 | Horodysky | 252/49.6 |
| 4,394,277 | 7/1983 | Small | 252/32.7 E |

*Primary Examiner*—Jacqueline V. Howard

*Attorney, Agent, or Firm*—Alexander J. McKillop; Michael G. Gilman; Van D. Harrison, Jr.

[57] ABSTRACT

Reduction of friction between metal parts in contact, reductions in corrosion of copper and oxidation of lubricants are made possible by adding to lubricant or liquid fuel a minor amount of a product made by reacting an epoxyhydrocarbon, a phenol sulfide and a boron compound.

18 Claims, No Drawings

BORATED EPOXYHYDROCARBON-PHENOL SULFIDE PRODUCT AND LUBRICANT AND FUEL COMPOSITIONS CONTAINING SAME

BACKGROUND OF THE INVENTION

1. Field of the Invention

The invention is concerned with certain additives and with lubricant and fuel compositions containing them. It more particularly relates to epoxyhydrocarbon-phenol sulfide borate and to lubricant and fuel compositions containing same.

2. Discussion of the Prior Art

It is known to use borated compounds in lubricants and fuels. These include borated alkanolamines, such as those disclosed in U.S. Pat. No. 4,382,006, and borated sulfur compounds, such as are exemplified in U.S. Pat. No. 4,394,277. Other U.S. patents disclosing additional borated additives are: U.S. Pat. Nos. 2,994,064; 3,007,873; 3,014,869; 3,014,869; 3,014,870; 3,076,835; 3,254,025; 3,449,362; 4,025,445; 4,328,113; 4,376,712; and 4,426,723.

The use of certain phenol sulfides in lubricants is known also. U.S. Pat. No. 4,305,832 discloses phenol sulfides, disulfides, polysulfides and oligomers thereof with alkyl ring ethers for the purpose. U.S. Pat. No. 4,330,421 discloses lubricants containing calcium phenol sulfides.

The additives and the lubricant and fuel compositions described herein provide substantial high temperature stability, friction reduction and antioxidant and antiwear properties. Such additives per se, and the compositions made therewith are new and have not, to the best of our knowledge, been described or suggested in the prior art in lubricants.

SUMMARY OF THE INVENTION

The invention provides a product made by reacting an epoxyhydrocarbon, a sulfurized phenol and a boron compound. It also provides a composition comprising a major proportion of a lubricant or a liquid fuel and a friction reducing amount of the said product, and a method of reducing fuel consumption therewith in an internal combustion engine.

DESCRIPTION OF SPECIFIC EMBODIMENTS

The epoxyhydrocarbons contemplated for use in this invention have the formula

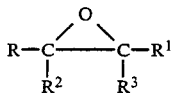

wherein R, $R^1$, $R^2$ and $R^3$ are hydrogen or $C_1$ to $C_{30}$, preferably $C_{10}$ to $C_{22}$ hydrocarbyl groups, at least one of which is a hydrocarbyl group. Included among the specific members embraced by the formula are 1,2-epoxyoctane, 1,2-epoxydecane, 1,2-epoxydodecane, 1,2-epoxytetradecane, 1,2-epoxypentadecane, 1,2-epoxyhexadecane, 1,2-epoxyheptadecane, 1,2-epoxyoctadecane, 1,2-epoxyeicosane, 1,2-epoxytriacontane, epoxides derived from propylene tetramers, butylene trimers, butylene tetramers, decene trimers, decene tetramers, and mixtures of such epoxides. "Hydrocarbyl" is meant broadly to include the preferred alkyl group as well as alkenyl, aryl, aralkyl, alkaryl, cycloalkyl and cycolalkenyl groups, all containing from 8 to 30 carbon atoms, preferably 10 to 22 carbon atoms. The aryl portions may contain 6 to 14 carbon atoms. Sulfurized phenols useful for the purpose of this invention have the formula

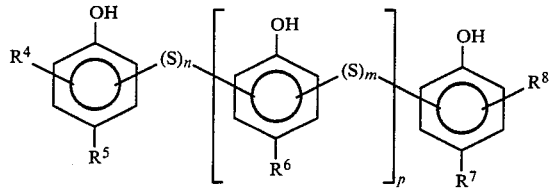

wherein $R^4$, $R^5$, $R^6$, $R^7$ and $R^8$ are hydrogen or the same of different hydrocarbyl groups containing 1 to 18 carbon atoms in any isomeric structural arrangement, and wherein with respect to $R^5$, $R^6$ and $R^7$ the total number of carbon atoms represented thereby cannot be less than 4 if 1 or 2 of such members are hydrogen, n and m are 1 to 4 and may be the same or different and p is 0 to 4. The sulfide, disulfide or polysulfide bridges may be at any of the ring positions, but positions ortho or para to the hydroxy groups are preferred.

In general, sulfurized phenols can be made by any method known to the art. In one method the phenol (e.g., p-t-octylphenol) is initially reacted with a sulfur halide (e.g., sulfur monochloride or dichloride) in a 1:1 to 3:1 ratio with a 3:2 ratio often preferred, and the resulting phenol sulfide may, if desired, be further reacted with other phenols and sulfur halide.

The novel compounds disclosed herein may be prepared from any suitable phenol sulfide, disulfide, polysulfide or oligomer thereof. Preferred are 2,2'-thiobis(alkylphenols), i.e., n=1 and p=0, or 2,2'-dithiobis(alkylphenols), i.e., n=2 and p=0, and oligomeric 2,2'-thiobis(alkylphenols). Preferred also are the 2,2'-dithiobis(alkylphenols) containing 3 or 4 alkylphenol units particularly those containing both sulfide and disulfide groups. In this latter case, when there are 3 alkylphenol units, p is 1 and n and m are at least 1. When there are 4 alkylphenol units, p is 2 and n and m are at least 1. Also in this matter case the alkyl moiety contains from 1 to 20 carbon atoms. More preferred are alkyl moieties containing from 4 to 12 carbon atoms. Especially preferred are groups such as nonyl and dodecyl, or mixtures thereof, often derived from propylene trimers, propylene tetramers or mixtures thereof, respectively.

Preferred boron compounds to effect boration are the metaborates. Preferred are the metaborates, boric acid, boric oxide and alkyl borates of the formula $$(RO)_xB(OH)_y$$

wherein R is a $C_1$ to $C_6$ alkyl group, x is 1 to 3 and y is 0 to 2, the sum of x and y being 3. The alkyl borates contemplated are the mono-, di- and trialkyl borates, i.e., the mono-, di- and trimethyl borates, mono-, di- and triethyl borates, mono-, di- and tripropyl borates, mono-, di- and tributyl borates, mono-, di- and triamyl borates and mono-, di- and trihexyl borates.

The products of the invention may be made by mixing all three reactants together and heating for the required time. It is contemplated that the reaction can be carried out at from about 80° C. to about 260° C., depending upon the reactants and whether or not a solvent is used. The reaction mixture will preferably have therein at least a stoichiometric amount of boron compound based on available reactive hydroxy and epoxide linkages. Excess boron can be used, so that the final product will have from about 0.01% to about 10% of boron per se therein. Overall, the molar ratios of phenol: epoxyalkane:boron compound may range from about 1:1:1 to about 1:6:8, preferably from about 1:2:1 to about 1:4:4 to form the mixed borate.

While atmospheric pressure is generally preferred, this reaction, or the ones mentioned below, can be advantageously run at from about 1 to about 5 atmospheres. Furthermore, where conditions warrant it, a solvent may be used, and is often preferred. In general, any realative non-polar, unreactive solvent can be used, including benzene, toluene, xylene and 1,4-dioxane. Other hydrocarbon and alcoholic solvents, the latter of which include propanol, butanol and the like, can be used but is not generally preferred. Mixtures of alcohol and hydrocarbon solvents can be used also.

It is not believed that the time of reaction is critical and that any of the reactions mentioned herein can be carried out in from about 1 to about 20 hours.

While it is preferred to prepare the product by mixing all reactants initially, it will be understood by the art that variations that give substantially similar products with substantially the same activity are deemed to be within the invention.

Examples of variations that we believe will substantially produce the product of our invention are:

(1) (boron compound + epoxide) + phenol sulfide; and (2) (boron compound + phenol sulfide) + epoxide in which the reactants in the parentheses are reacted first and the product obtained is reacted with the third reactant.

The liquid fuels improved in accordance with the present invention comprise those which are normally susceptible to forming undesirable carburetor and intake valve deposits in internal combustion engine. Specifically, liquid hydrocarbon fuels boiling from about 75° F. to about 750° F., including gasoline, jet fuel and dies fuel may be mentioned. Of particular significance is the treatment of petroleum distillate fuels having an initial boiling point of about 75° F. to about 135° F. and an end boiling point from about 250° F. to about 750° F. It should be noted, in this respect, that the term "distillate fuels" or "distillate fuel oils" is not intended to be restricted to straight-run distillate fractions. These distillate fuel oils can comprise straight run distillate fuel oils, catalytically or thermally cracked (including hydrocracked) distillate fuel oils or mixtures of straight run distillate fuel oils, naphthas and the like, with cracked distillate stocks. Moreover, such fuel oils can be treated in accordance with such well known commercial methods as acid or caustic treatment, hydrogenation, solvent refining, clay treatment and the like.

The distillate fuels are characterized by their relatively low viscosity, pour point and the like. The principle property which characterizes these hydrocarbons, however, is their distillate range. As hereinbefore indicated, this range will lie between about 75° F. and about 750° F. Obviously the distillation range of each individual fuel will cover a narrower boiling range, falling nevertheless, within the above-specified limits. Likewise, each fuel will boil substantially continuously throughout its distillation range.

In addition to the hydrocarbon fuels mentioned, other fuels improved by the disclosed additives are alcohols such as methyl alcohol and ethyl alcohol, mixtures thereof and mixtures with the hydrocarbon fuels disclosed herein.

Particularly contemplated among the fuels or fuel oils are Nos. 1, 2 and 3 fuel oils, used in heating and as diesel fuel oils, gasoline and jet combustion fuels. The domestic fuel oils generally conform to the specifications set forth in ASTM specification D396-48T. Specifications for diesel fuels are defined in ASTM specification D975-48T. Typical jet fuels are defined in military specification MIL-F-624B. In addition, fuel oils of varying viscosity and pour points falling both within and outside the indicated ranges may also be effectively treated through the use of the additives of the present invention.

In general, the disclosed additives are employed in the liquid fuel in a minor amount, i.e., an amount effective for imparting the desired activity. More specifically, it can be used at a concentration from about 0.001 to about 10% and preferably from about 0.01 to 0.5 wt. % based on the total weight of the fuel. The concentration of the additive of this invention in fuels may also be stated in terms of pounds of fuel per 1000 barrels (bbls) thereof. Thus, the additives can be used in the fuel within the range of from about 25 pounds/1,000 barrels to about 500 pounds/1,000 barrels. Any other known additive (as for example, antioxidants and dispersants) generally, may also be used in fuel compositions containing the additives hereof for their known purposes without adverse effect to such compositions.

The disclosed products may also be incorporated in lubricating media which may comprise either a mineral oil, a synthetic oil, mixtures thereof, or it may comprise a grease in with any of the aforementioned oils are employed as a vehicle. The resulting composition can also contain detergents and dispersants, s well as antioxidants, inhibitors, antiwaer, extreme pressure, antifoam, pour depressant and viscosity index improving additives without negating the beneficial properties of the novel compositions of this invention. The compositions can include commonly used additives such as phenates, sulfonates, polymers, metal dithiophosphates such as zinc or molybdenum dithiophosphates, succinimides, and the like. In general, mineral oils employed as the lubricant or grease vehicle may be of any suitable lubricating viscosity range as, for example, from about 45 SSU at 100° F. to about 6,000 SSU at 100° F. and preferably from about 50 SSU at 210° F. to about 250 SSU at 210° F. These oils may have viscosity indexes varying from below 0 to about 100 or higher. Viscosity indexes from about 70 to about 95 are preferred. The average molecular weights of these oils may range from about 250 to 800. Where the lubricant is to be employed in the form of a grease, the lubricating oil is generally employed in an among sufficient to balance the total grease composition, after accounting for the desired quantity of the thickening agent, and other additive components to be included in the grease formulation.

In instances where synthetic oils and mixtures of synthetic oil and mineral oil are desired in preference to mineral oils only, various compounds of this type may be successfully utilized. Typical synthetic vehicles include polyisobutylene, polybutenes, hydrogenated polydecenes, polypropylene glycol, polyethylene glycol, trimethylol propane esters, neopentyl and pentaerythritol esters, di(2-ethylhexyl) sebacate, di(2-ethylhexyl) adipate, di(-butylphthalate) fluorocarbons, silicate esters, silanes, esters of phosphorus-containing acids, liquid ureas, ferrocene derivatives, hydrogenated mineral oils, chain-type polyphenols, siloxanes and silicones (polysiloxanes), alkyl-substituted diophenyl ethers typified by a butyl-substituted bis(p-penoxyl phenyl) ether, phenoxy phenylethers, etc.

A wide variety of thickening agents can be used in forming the greases of this invention. Included among the preferred thickening agents are alkali and alkaline earth metal soaps of fatty acids and fatty materials having from 12 to about 30 carbon atoms per molecule. The metals are typified by sodium, lithium, calcium and barium. Fatty materials are illustrated by stearic acid, hydroxy-stearic acid, stearin, cottonseed oil acids, oleic acid, palmitic acid, myristic acid and hydrogenated fish oils.

Other thickening agents include salt and salt-soap complexes as calcium stearate-acetate (U.S. Pat. No. 2,197,263), barium stearate acetate (U.S. Pat. No. 2,564,561), calcium, stearate-caprylate-acetate complexes (U.S. Pat. No. 2,999,065), calcium caprylate-acetate (U.S. Pat. No. 2,999,066), and calcium salts and soaps of low-, intermediate- and high-molecular weight acids and of nut oil acids.

Another group of thickening agents comprises substituted ureas, phthalocyamines, indanthrene, pigments such as perylimides, pyromellitdiimides, and ammeline.

The preferred thickening agents employed in the grease compositions are essentially hydrophobic clays. Such thickening agents can be prepared from clays which are initially hydrophilic in character, but which have been coverted into a hydrophobic condition by the introduction of long-chain hydrocarbon radicals onto the surface of the clay particles; prior to their use as a component of a grease composition, as, for example, by subjecting them to a preliminary treatment with an organic cationic surface active agent, such as an onium compound. Typical onium compounds are tetraalkylammonium chlorides, such as dimethyl dioctadecyl ammonium chloride, dimethyl dibenzyl ammonium chloride and mixtures thereof. This method of conversion, being well known to those skilled in the art, is believed to require no further discussion, and does not form a part of the present invention.

The following Examples provide specific illustrations of the products and compositions of the invention. They are illustrative only, and are not meant to limit the invention.

EXAMPLE 1

1,2-Epoxyhexadecane-Dodecylphenol Sulfide Borate

Approximately 60 g of 1,2-epoxyhexadeacane (obtained from Union Carbide Co.), 135 g of 50% dodecylphenol sulfide (made by reacting 3 moles of dodecylphenol with 2 moles of sulfur dichloride at 100° to 150° C. for 6 hours with agitation followed by vacuum topping to remove residual HCl) in 100" solvent paraffinic neutral lubricating diluent oil, 100 g of toluene solvent and 20 g of boric acid were charged to a reactor equipped with agitator, heater, Dean-Start tube with condenser and provision for maintaining an inert nitrogen atmosphere. The reactor contents were heated up to 170° C. over a period of 6 hours until water evolution ceased. The solvent was removed by distillation under reduced pressure and the product was then filtered through diatomaceous earth.

EXAMPLE 2

1,2-Epoxytetradecane-Dodecylphenol Sulfide Borate

Approximately 55 g of 1,2-epoxytetradecane (obtained from Viking Chemical Co.), 135 g of 50% dodecylphenol sulfide oil concentration described in Example 1, 100 g of toluene and 20 g of boric acid were charged to a reactor equipped as generally described in Example 1. The reactor contents were heated up to 170° C. over a period of 7 hours until water evolution ceased. The solvent was removed by distillation at 170° C. under reduced pressure and the product was filtered at about 120° C. through diatomaceous earth.

EXAMPLE 3

1,2-Epoxydodecane-Dodecylphenol Sulfide Borate

Approximately 50 g of 1,2-epoxydodecane, 135 g of 50% dodecylphenol sulfide oil concentrate described in Example 1, 100 g of toluene and 20 g of boric acid were charged to a reactor equipped as generally described in Example 1. The reactor contents were heated up to 180° C. over a period of 8 hours until water evolution ceased. The solvent was removed by distillation at 180° C. under reduced pressure and the product was filtered through diatomaceous earth.

EVALUATION OF THE COMPOUNDS

The products were evaluated in a Low Velocity Friction Apparatus (LVFA) in a fully formulated 5W-30 synthetic or 10W-40 mineral automotive engine containing an additive package which includes antioxidant, dispersant and detergent. The test compounds were used at concentrations by weight of the total weight of oil shown in Table 1. The tables show the concentrations of test compounds used. These also summarize the test results obtained in the various tests.

DESCRIPTION

The Low Velocity Friction Apparatus (LVFA) is used to measure the coefficient of friction of test lubricants under various loads, temperatures, and sliding speeds. The LVFA consists of a flat SAE 1020 steel surface (diameter 1.5 in.) which is attached to a drive shaft and rotated over a stationary, raised, narrow ringed SAE 1020 steel surface (area 0.08 in.$^2$). Both surfaces are submerged in the test lubricant. Friction between the steel surfaces is measured as a function of the sliding speed at a lubricant temperature of 250° F. The friction between the rubbing surfaces is measured using a torque arm-strain gauge system. The strain gauge output, which is calibrated to be equal to the coefficient of friction, is fed to the Y axis of an X-Y plotter. The speed signal from the tachometer-generator is fed to the X-axis. To minimize external friction, the piston is supported by an air bearing. The normal force loading the rubbing surfaces is regulated by air pressure on the bottom of the piston. The drive system consists of an infinitely variable-speed hydraulic transmission driven by a ½ HP electric motor. To vary the sliding speed, the output speed of the transmission is regulated by a lever-cam motor arrangement.

PROCEDURE

The rubbing surfaces and 12–13 ml of test lubricants are placed on the LVFA. A 240 psi load is applied, and the sliding speed is maintained at 40 fpm at ambient temperatures for a few minutes. A plot of coefficients of friction ($U_k$) vs. speed were taken at 240, 300, 400, and 500 psi. Freshly polished steel specimens are used for each run. The surface of the steel is parallel ground to 4 to 8 microinches. The results in Tables 1 and 2 refer to percent reduction in friction compared to the unmodified oil. That is, the formulation mentioned above was tested without the compound of this invention and this became the basis for composition. The results were obtained at 250° F. and 500 psi.

TABLE 1

| Frictional Properties Evaluated Using the Low Velocity Friction Apparatus | | | |
|---|---|---|---|
| | Additive Conc. in Test Oil, | % Reduction in Coefficient of Friction @ | |
| Additive | Wt. % | 5 Ft./Min. | 30 Ft./Min. |
| None | — | 0 | 0 |
| Test Oil (SAE 10W-40 fully formulated mineral engine oil with detergent/dispersant/inhibitor performance package | | | |
| Example 1 | 4 | 44 | 36 |
| | 2 | 27 | 16 |
| Example 2 | 2 | 33 | 30 |
| Example 3 | 4 | 23 | 16 |
| | 2 | 24 | 15 |
| None | | | |
| Test Oil (SAE 5W-30 fully formulated synthetic automotive engine oil with detergent/dispersant/inhibitor performance package | — | 0 | 0 |
| Example 1 | 2 | 25 | 11 |
| Example 2 | 4 | 28 | 21 |
| Example 3 | 4 | 30 | 18 |

The products were also evaluated for high temperature and oxidative stability. Basically, the test lubricant is subjected to a stream of air which is bubbled through the test lubricant at a rate of 5 liter per hour at 325° F. for 40 hours. Present in the composition are samples of metals commonly used in engine construction, namely iron, copper, aluminum and lead. See U.S. Pat. No. 3,682,980 for further details of the test. Improvement in percent viscosity increase shows effective control.

TABLE 2

| Catalytic Oxidation Test | | |
|---|---|---|
| Additive | Conc. In the Base Oil Wt. % | % Increase in Viscosity of Used Oil vs. New Oil @ 100° C., KV |
| Base Oil - 200" Solvent Paraffinic Neutral Mineral Lubricating Oil | — | 27 |
| Example 1 | 1 | 20 |
| Example 2 | 1 | 14 |
| Example 3 | 1 | 12 |

The products' propensity to corrode copper (due primarily to the contained sulfur groups) was measured in lubricants using th ASTM D130-80 Copper Strip Corrosivity Test at two different, but severe conditions of time and temperature. As can be seen from the data, the products of the examples are surprisingly non-corrosive to copper even though they contain potentially corrosive sulfur. Antiwear benefits are thus realized from the contained sulfur and boron moieties without any of the traditionally expected drawbacks.

TABLE 3

| | Copper Strip Corrosivity | | |
|---|---|---|---|
| Additive | Conc. in 200" SPN Test Oil, Wt. % | ASTM D130-80 3 Hrs. @ 250° F. | ASTM D130-80 6 Hrs. @ 212° F. |
| Example 1 | 1 | 1A | 1A |
| Example 2 | 1 | 1A | 1A |
| Example 3 | 1 | 1A | 1A |

I claim:

1. A product made by reacting (1) a phenol sulfide of the formula

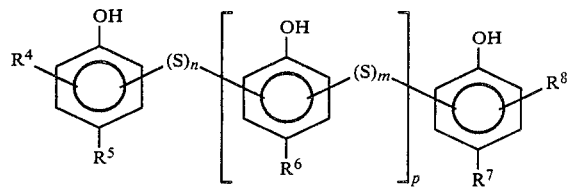

wherein $R^4$, $R^5$, $R^6$, $R^7$ and $R^8$ are hydrogen or the same or different hydrocarbyl groups containing 1 to 18 carbon atoms in any isomeric structural arrangement, and wherein with respect to $R^5$, $R^6$ and $R^7$ the total number of carbon atoms represented thereby cannot be less than 4 if 1 or 2 of such members are hydrogen, n and m are 1 to 4 and may be the same or different and p is 0 to 4 with (2) an epoxyhydrocarbon of the formula

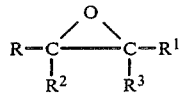

wherein R, $R^1$, $R^2$ and $R^3$ are hydrogen or $C_1$ to $C_{30}$ hydrocaryl groups, at least one of which is a hydrocarbyl group and (3) a boron compound selected from the group consisting of metaborates, boric acid, boric oxide and alkyl borates of the formula $$(RO)_xB(OH)_y$$

wherein R is a $C_1$ to $C_6$ alkyl group, x is 1 to 3 and y is 0 to 2, their sum being 3, the reaction being carried out at from about 80° C. to about 260° C. using respective molar ratios of reactants of from about 1:1:1 to about 1:6:8.

2. The product of claim 1 wherein the phenol sulfide is a thiobis(alkylphenol), an oligomer thereof, dithiobis (alkylphenol) or polythio (alkylphenol) containing 3 or 4 alkylphenol groups and wherein in any of these the alkyl group contains from 1 to 20 carbon atoms.

3. The product of claim 1 wherein the epoxyhydrocarbon is 1,2-epoxyoctane, 1,2-epoxydecane, 1,2-epoxydodecane, 1,2-epoxytetradecane, 1,2-epoxypentadecane, 1,2-epoxyhexadecane, 1,2-epoxyheptadecane, 1,2-epoxyoctadecane, 1,2-epoxyeicosane, epoxides from propylene trimers, propylene tetramers, decene trimers, decene tetramers or mixture of any of these.

4. The product of claim 1 wherein the phenol sulfide is made in accordance with Example 1, the epoxyhydrocarbon is 1,2-epoxyhexadecane and the boron compound is boric acid.

5. The product of claim 1 wherein the phenol sulfide is made in accordance with Example 1, the epoxyhydrocarbon is epoxytetradecane and the boron compound is boric acid.

6. The product of claim 1 wherein the phenol sulfide is made in accordance with Example 1, the epoxyhydrocarbon is 1,2-epoxydodecane and the boron compound is boric acid.

7. A composition comprising a major proportion of a lubricant and a friction reducing amount of a product made by reacting (1) a phenol sulfide of the formula

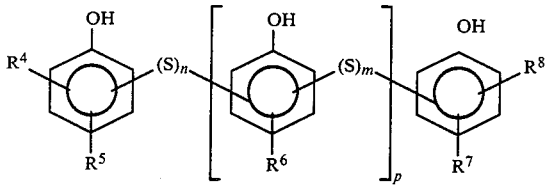

wherein $R^4$, $R^5$, $R^6$, $R^7$ and $R^8$ are hydrogen of the same or different hydrocarbyl groups containing 1 to 18 carbon atoms in any isomeric structural arrangement, and wherein with respect to $R^5$, $R^6$ and $R^7$ the total number of carbon atoms respresented thereby cannot be less than 4 if 1 or 2 of such members are hydrogen, n and m are 1 to 4 and may be the same or different and p is 0 to 4 with (2) an epoxyhydrocarbon of the formula

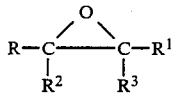

wherein R, $R^1$, $R^2$ and $R^3$ are hydrogen or $C_1$ to $C_{30}$ hydrocarbyl groups, at least one of which is a hydrocarbyl group and (3) a boron compound selected from the group consisting of metaborates, boric acid, boric oxide and alkyl borates of the formula $$(RO)_xB(0H)_y$$

wherein R is a $C_1$ to $C_6$ alkyl group, x is 1 to 3 and y is 0 to 2, their sum being 3, the reaction being carried out at from about 80° C. to about 260° C. using respective molar ratios of reactants of from about 1:1:1 to about 1:6:8.

8. The composition of claim 7 wherein the phenol sulfide is a thiobis(alkylphenol), an oligomer thereof, dithiobis (alkylphenol) or polythio (alkylphenol) containing 3 or 4 alkylphenol groups and wherein in any of these the alkyl group contains from 1 to 20 carbon atoms.

9. The composition of claim 7 wherein the epoxyhydrocarbon is 1,2-epoxyoctane, 1,2-epoxydecane, 1,2-epoxydodecane, 1,2-epoxytetradecane, 1,2-epoxypentadecane, 1,2-epoxyhexadecane, 1,2-epoxyheptadecane, 1,2-epoxyoctadecane, 1,2-epoxyeicosane, epoxides from propylene trimers, propylene tetramers, decene trimers, decene tetramers or mixture of any of these.

10. The composition of claim 7 wherein the phenol sulfide is made in accordance with Example 1, the epoxyhydrocarbon is 1,2-epoxyhexadecane and the boron compound is boric acid.

11. The composition of claim 7 wherein the phenol sulfide is made in accordance with Example 1, the epoxyhydrocarbon is epoxytetradecane and the boron compound is boric acid.

12. The composition of claim 7 wherein the phenol sulfide is made in accordance with Example 1, the epoxyhydrocarbon is 1,2-epoxydodecane and the boron compound is boric acid.

13. The composition of claim 7 wherein said lubricant is a lubricating oil selected from the group consisting of (1) a mineral oil, (2) a synthetic oil or a mixture of synthetic oils, (3) a mixture of (1) and (2) and (4) a grease of (1), (2) or (3).

14. The composition of claim 13 wherein the oil is a mineral oil.

15. The composition of claim 13 wherein the oil is a synthetic oil or mixture of synthetic oils.

16. The composition of claim 13 wherein the oil is said mixture of (3).

17. The composition of claim 13 wherein the lubricant is the grease of (4).

18. A method of reducing fuel consumption in an internal combustion engine by (1) lubricating said engine with a composition comprising a major proportion of a lubricating oil and a friction reducing amount of a product made by reacting (a) a phenol sulfide of the formula

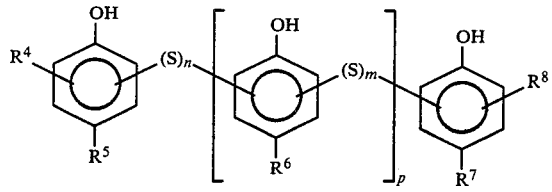

wherein $R^4$, $R^5$, $R^6$, $R^7$ and $R^8$ are hydrogen or the same or different hydrocarbyl groups containing 1 to 18 carbon atoms in any isomeric structural arrangement, and wherein with respect to $R^5$, $R^6$ and $R^7$ to total number of carbon atoms respresented thereby cannot be less than 4 if 1 or 2 of such members are hydrogen, n and m are 1 to 4 and may be the same or different and p is 0 to 4 with (b) an epoxyhydrocarbon of the formula

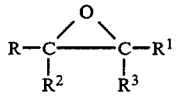

wherein R, $R^1$, $R^2$ and $R^3$ are hydrogen or $C_1$ to $C_{30}$ hydrocarbyl groups, at least one of which is a hydrocarbyl group and (c) a boron compound selected from the group consisting of metaborates, boric acid, boric oxide and alkyl borates of the formula $$(RO)_xB(OH)_y$$

wherein R is a $C_1$ to $C_6$ alkyl group, x is 1 to 3 and y is 0 to 2, their sum being 3, the reaction being carried out at from about 80° C. to about 260° C. using respective molar ratios of reactants of from about 1:1:1 to about 1:6:8.

* * * * *

UNITED STATES PATENT AND TRADEMARK OFFICE

CERTIFICATE OF CORRECTION

PATENT NO. : 4,541,942

DATED : September 17, 1985

INVENTOR(S) : Andrew G. Horodysky

It is certified that error appears in the above-identified patent and that said Letters Patent is hereby corrected as shown below:

Column 1, line 10, after "relates to" insert --a--.
Column 1, line 16, after "and" insert --certain--.
Column 2, line 51, delete ". Preferred are the metaborates".
Column 3, line 14, "realative" should read --relatively--.
Column 4, line 19, "10%" should read -- 10 wt. %--.
Column 4, line 33, "with" should read --which--.
Column 5, line 32, "coverted" should be --converted--.
Column 5, line 53, "1,2-epoxyhexadeacane" should read --1,2-epoxyhexadecane--.
Column 5, line 62, "Dean-Start" should read --Dean Stark--.
Column 6, line 32, after "engine" insert --oil--.
Column 9, line 22, "of" should be --or--.
Column 10, line 41, "to total" should read --the total--.

Signed and Sealed this

*Seventh* Day of *January 1986*

[SEAL]

*Attest:*

*Attesting Officer*

DONALD J. QUIGG

*Commissioner of Patents and Trademarks*